US011920281B2

(12) United States Patent
Damtew

(10) Patent No.: US 11,920,281 B2
(45) Date of Patent: Mar. 5, 2024

(54) SYSTEMS FOR APPLIANCE DETERGENT DISPENSING

(71) Applicant: Haier US Appliance Solutions, Inc., Wilmington, DE (US)

(72) Inventor: FikreAdam Abebe Damtew, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/680,391

(22) Filed: Feb. 25, 2022

(65) Prior Publication Data

US 2023/0272572 A1 Aug. 31, 2023

(51) Int. Cl.
*D06F 39/02* (2006.01)
*D06F 23/02* (2006.01)

(52) U.S. Cl.
CPC ..... *D06F 39/028* (2013.01); *D06F 23/02* (2013.01); *D06F 39/022* (2013.01)

(58) Field of Classification Search
None
See application file for complete search history.

(56) References Cited

U.S. PATENT DOCUMENTS

| | | | | |
|---|---|---|---|---|
| 7,770,418 | B2 | 8/2010 | Kramme et al. | |
| 9,803,311 | B2 | 10/2017 | Lee et al. | |
| 2003/0145633 | A1* | 8/2003 | Merkle | D06F 39/02 68/17 R |
| 2014/0190220 | A1* | 7/2014 | Lee | D06F 39/022 68/17 R |
| 2016/0258106 | A1 | 9/2016 | Kim | |
| 2019/0153657 | A1* | 5/2019 | Clayton | D06F 39/085 |

FOREIGN PATENT DOCUMENTS

| | | |
|---|---|---|
| EP | 3026165 B1 | 8/2017 |
| KR | 101781870 B1 | 9/2017 |

* cited by examiner

*Primary Examiner* — Cristi J Tate-Sims
(74) *Attorney, Agent, or Firm* — Dority & Manning, P.A.

(57) ABSTRACT

A washing machine includes a cabinet, a tub positioned in the cabinet, a basket assembly mounted in the tub, a manifold mounted in the cabinet, and a dispenser box slidably mounted to the manifold. The dispenser box is configured to provide selective access to an interior of the dispenser box, and a powder detergent chamber is configured for receiving powder detergent. A drawer is slidably mounted to the dispenser box within the interior of the dispenser box. The drawer defines a liquid detergent chamber. Liquid detergent chamber nests within the powder detergent chamber in the interior of the dispenser box.

18 Claims, 5 Drawing Sheets

SYSTEMS FOR APPLIANCE DETERGENT DISPENSING

FIELD OF THE INVENTION

The present subject matter relates generally to detergent dispensing in appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket and/or an agitator can rotate at various speeds to agitate articles within the wash chamber, to wring wash fluid from articles within the wash chamber, etc. During a spin or drain cycle of a washing machine appliance, a drain pump assembly may operate to discharge water from within a sump.

The fluids used during a cleaning cycle typically include water that may be combined with various additives, such as detergent, fabric softener, bleach, and combinations thereof. Conventionally, either a powder form of additive or a liquid form of additive may be used, or, there is not a convenient way to use both powder and liquid additive simultaneously. If the user chooses to use a powder additive, the user must remove the liquid additive chamber in order to expose the powder additive chamber.

BRIEF DESCRIPTION OF THE INVENTION

Aspects and advantages of the invention will be set forth in part in the following description, or may be apparent from the description, or may be learned through practice of the invention.

A washing machine includes a cabinet, a tub positioned in the cabinet, a basket assembly mounted in the tub, a manifold mounted in the cabinet, and a dispenser box slidably mounted to the manifold. The dispenser box is configured to provide selective access to an interior of the dispenser box, wherein a powder detergent chamber is configured for receiving powder detergent. The powder detergent chamber is defined by the dispenser box at the interior of the dispenser box, and wherein a drawer is slidably mounted to the dispenser box within the interior of the dispenser box. The drawer defines a liquid detergent chamber, configured for receiving liquid detergent. The liquid detergent chamber nests within the powder detergent chamber in the interior of the dispenser box.

A washing machine includes a cabinet defining the exterior appearance of the washing machine, as well as a tub positioned in the cabinet. Also included is a basket assembly rotatably mounted in the tub, a manifold mounted in the cabinet, and a dispenser box slidably mounted to the manifold. The dispenser box configured to provide selective access to an interior of the dispenser box, and a single valve action to flush the dispenser box. A powder detergent chamber, configured for receiving powder detergent, is defined by the dispenser box at the interior of the dispenser box. Additionally, a drawer is slidably mounted to the dispenser box within the interior of the dispenser box, and the drawer defines a liquid detergent chamber. The liquid detergent chamber is configured for receiving liquid detergent, and the liquid detergent chamber is nested within the powder detergent chamber in the interior of the dispenser box. The single valve action flushes both the liquid detergent chamber and the powder detergent chamber simultaneously.

A washing machine includes a cabinet defining the exterior appearance of the washing machine, and a tub positioned in the cabinet. Also included is a basket assembly rotatably mounted in the tub, a manifold mounted in the cabinet, and a dispenser box slidably mounted to the manifold. The dispenser box movable between an open and a closed position in order to provide selective access to an interior of the dispenser box, and a single valve action to flush the dispenser box. A powder detergent chamber, configured for receiving powder detergent, is defined by the dispenser box at the interior of the dispenser box. Additionally, a drawer is slidably mounted to the dispenser box within the interior of the dispenser box. The drawer defines a liquid detergent chamber, wherein the single valve action flushes both the liquid detergent chamber and the powder detergent chamber simultaneously. The drawer further includes a first position configured for receiving liquid detergent. The liquid detergent chamber is nested on top of the powder detergent chamber in the interior of the dispenser box. The drawer further includes a second position configured to provide selective access to the powder detergent chamber by selectively/independently sliding the liquid detergent chamber in the horizontal direction, which exposes the powder detergent chamber. When the dispenser box is put into the closed position, the drawer defaults to the first position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
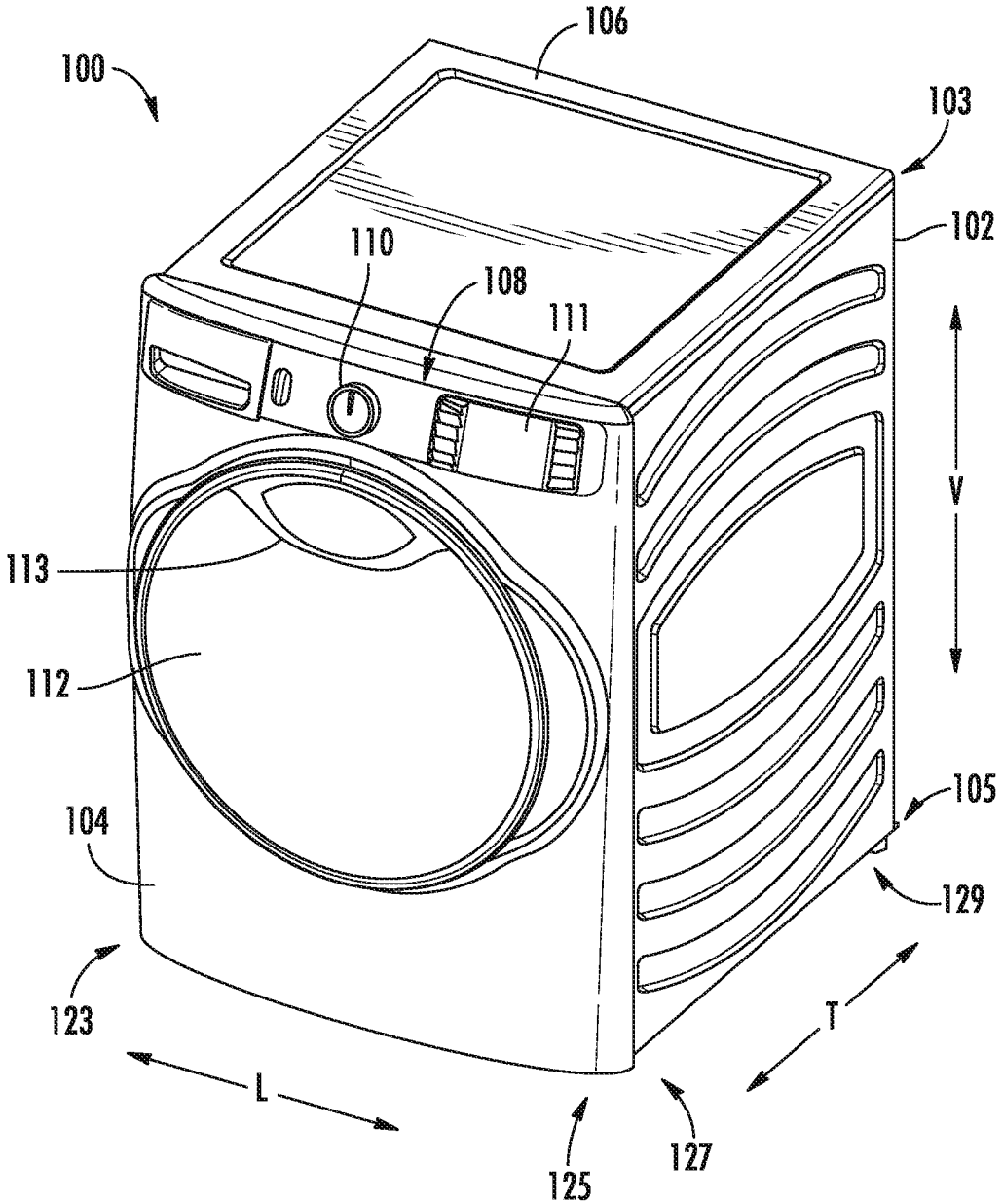
FIG. 1 provides a front, perspective view of a washing machine according to an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
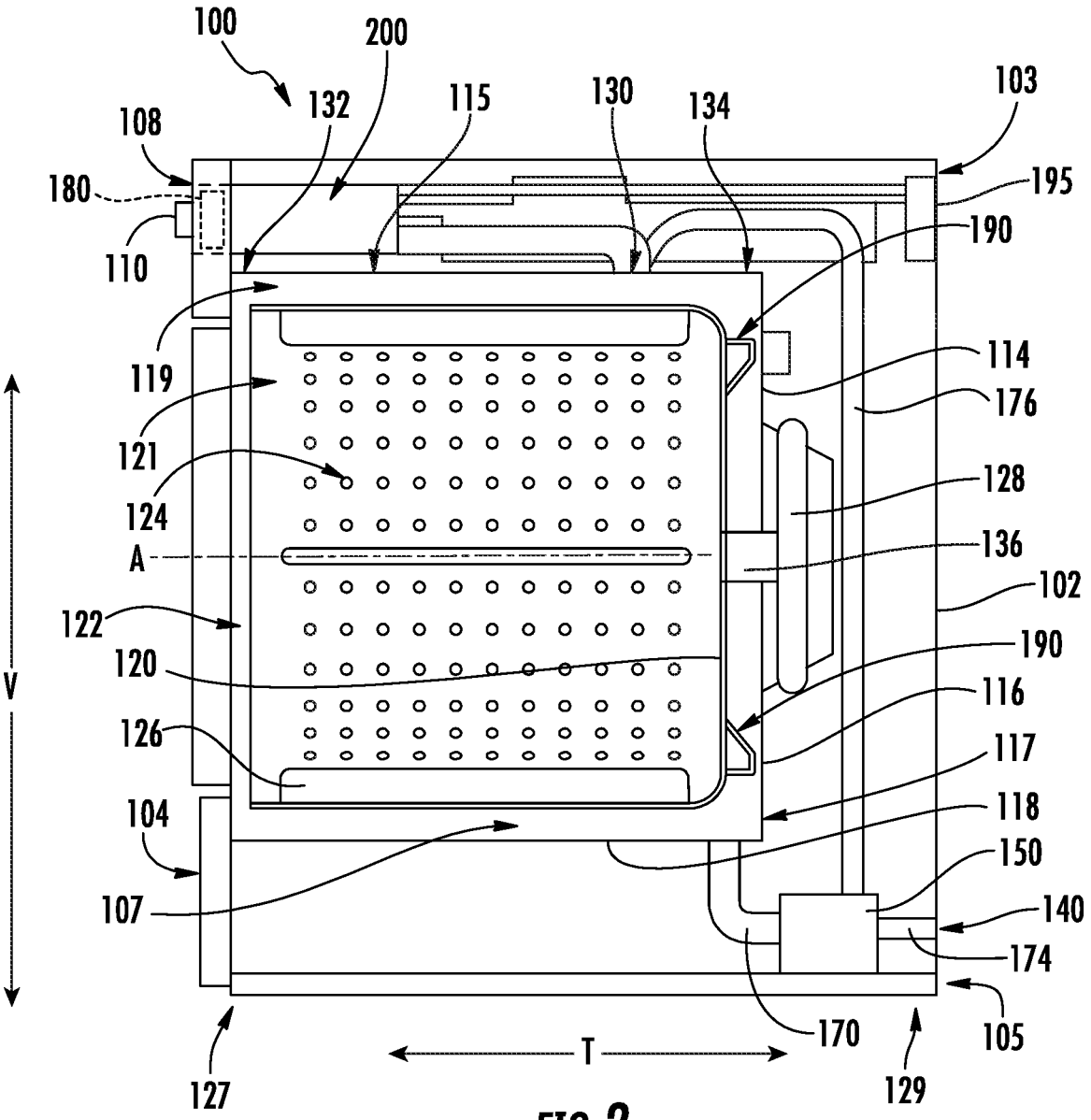
FIG. 2 provides a side, cross-sectional view of the example washing machine of FIG. 1.

FIGS. 1 and 2 provide various views of an example washing machine 100 according to one example embodiment of the present disclosure. In particular, FIG. 1 provides a front, perspective view of horizontal axis washing machine 100 and FIG. 2 provides a side, section view of washing machine 100. As shown in FIG. 1, washing machine 100 includes a cabinet 102 that extends between a top 103 and a bottom 105, e.g., along a vertical direction V. Cabinet 102 also extends between a first side 123 and a second side 125, e.g., along a lateral direction L, and between a front 127 and a rear 129, e.g., along a transverse direction T. The vertical, lateral, and transverse directions V, L, T defined by washing machine 100 are mutually perpendicular and together define an orthogonal direction system. Cabinet 102 may form a receiving space.

Cabinet 102 includes a front panel 104. A door 112 may be mounted to front panel 104 and may be rotatable between an open position (not shown) facilitating access to a wash drum or basket 120 (FIG. 2) located within cabinet 102, and a closed position (shown in FIGS. 1 and 2) hindering access to basket 120. A user may pull on a handle 113 in order to selectively adjust door 112 between the open and closed positions. Cabinet 102 also includes a top panel 106 positioned at top 103 of cabinet 102.

A control panel 108 including a plurality of input selectors 110 may be coupled to front panel 104. Control panel 108 and input selectors 110 collectively form a user interface input for operator selection of machine cycles and features. For example, in some embodiments, control panel 108 includes a display 111 (FIG. 1) configured to present or indicate selected features, a countdown timer, and/or other items of interest to machine users.

As shown in FIG. 2, a tub 114 defines a wash fluid compartment 119 configured for receipt of a washing fluid. Thus, tub 114 is configured for containing washing fluid, e.g., during operation of washing machine 100. Washing fluid disposed within tub 114 may include, for example, at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of washing machine 100. For example, during operation of washing machine 100, washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of washing machine 100 in order to remove fluid from tub 114. Fluid received by drain 140 from pump assembly 150 is directed out of washing machine 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of washing machine 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine 100 as described below. In particular, a shaft 136 mechanically couples motor 128 with basket 120 and drivingly rotates basket 120 about a shaft or central axis A, e.g., during a spin cycle. Ribs 126 may extend from basket 120 into wash chamber 121. Ribs 126 may assist agitation of articles disposed within wash chamber 121 during operation of washing machine 100. For example, ribs 126 may lift articles disposed in basket 120 during rotation of basket 120.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in washing machine 100 and can be placed according to any known or desirable configuration. For example, two balancing rings can be respectively placed at the front and back of basket 120.

As further shown in FIG. 2, washing machine 100 includes a dispenser box 200 for the dispensing of detergent. Dispenser box 200 may include features for receiving various wash treatment additives (e.g., fluid detergent, powder detergent, fabric softener, bleach, powder or any other suitable liquid) and dispensing or directing them to wash fluid compartment 119 of tub 114 during operation of washing machine 100. Dispenser box 200 will be described in further detail herein.

Operation of washing machine 100 is controlled by a processing device or controller 180 that is operatively coupled to control panel 108 for user manipulation to select washing cycles and features. In response to user manipulation of control panel 108, controller 180 operates the various components of washing machine 100 to execute selected machine cycles and features, which will be described in further detail herein.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, gates, and the like) to perform control functionality instead of relying upon software. Control panel 108 and other components of washing machine 100 may be in communication with controller 180 via one or more signal lines or shared communication busses.

In an illustrative example of operation of washing machine 100, laundry items are loaded into basket 120, and a washing operation is initiated through operator manipulation of input selectors 110. Tub 114 may be filled with water and one or more wash treatment additives from dispenser box 200 to form a wash fluid. One or more valves of a water inlet valve 195 can be actuated by controller 180 to provide for filling tub 114 to the appropriate level for the amount (or number) of articles being washed. Water inlet valve 195 is in fluid communication with a water source, such as e.g., a hot water heater and/or a municipal water line. Once tub 114 is properly filled with wash fluid, the contents of basket 120 may be agitated with ribs 126 for cleansing of laundry items in basket 120.

After the agitation phase (e.g., first agitation phase, second agitation phase, etc.) of the wash cycle is completed, tub 114 may be drained. Laundry articles may then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During the spin cycle, basket 120 is rotated at relatively high speeds.

While described in the context of a specific embodiment of horizontal axis washing machine 100, it will be understood that horizontal axis washing machine 100 is provided by way of example only. Other washing machines having different configurations, different appearances, and/or different features may also be utilized with the present subject matter as well, including, for example, vertical-axis washing machines. Thus, the teachings of the present disclosure are not limited to use with washing machine 100.

Figure 3:
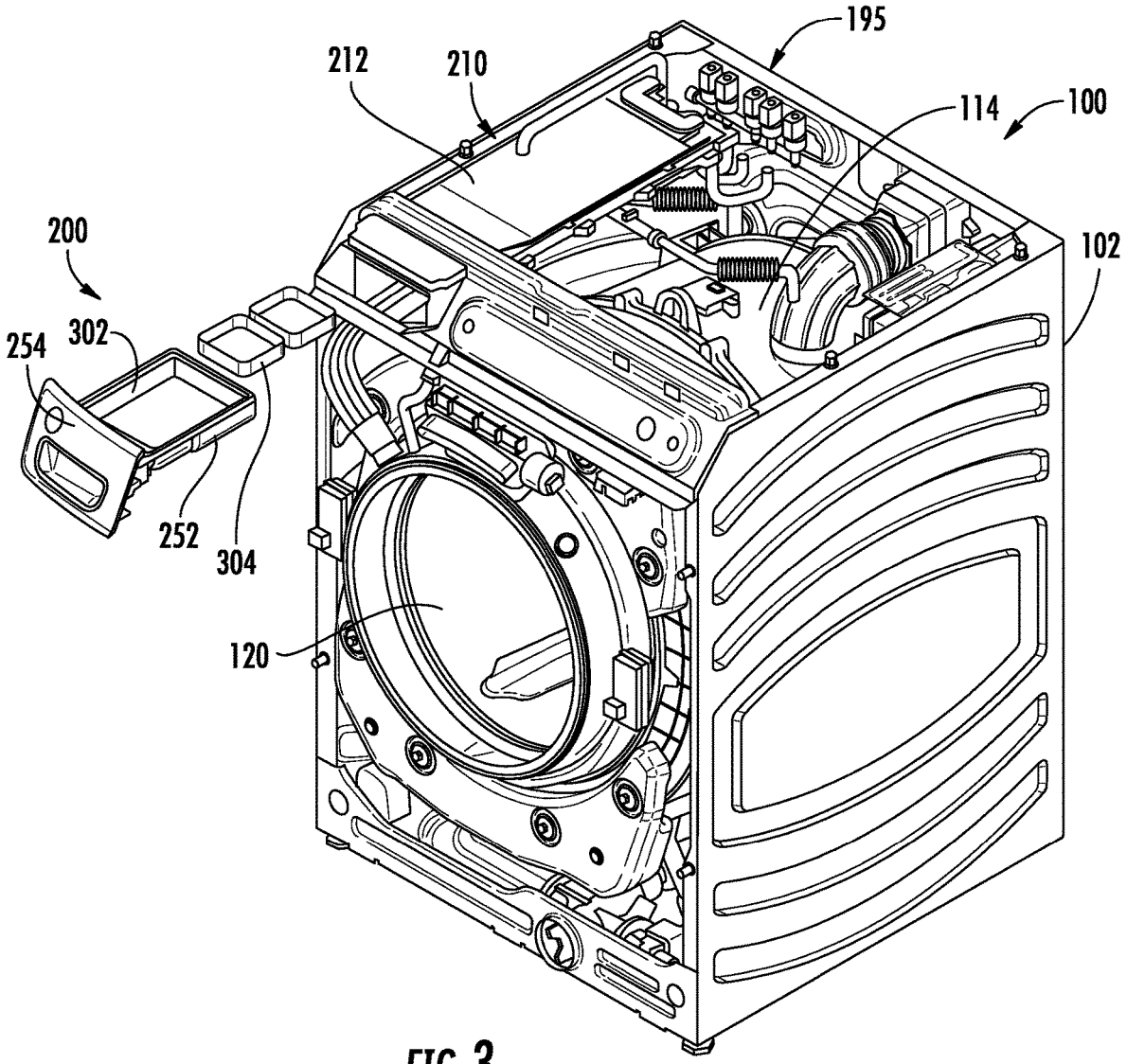
FIG. 3 provides a partial exploded perspective view of the dispenser box of the washing machine of FIG. 1.
Figure 4:
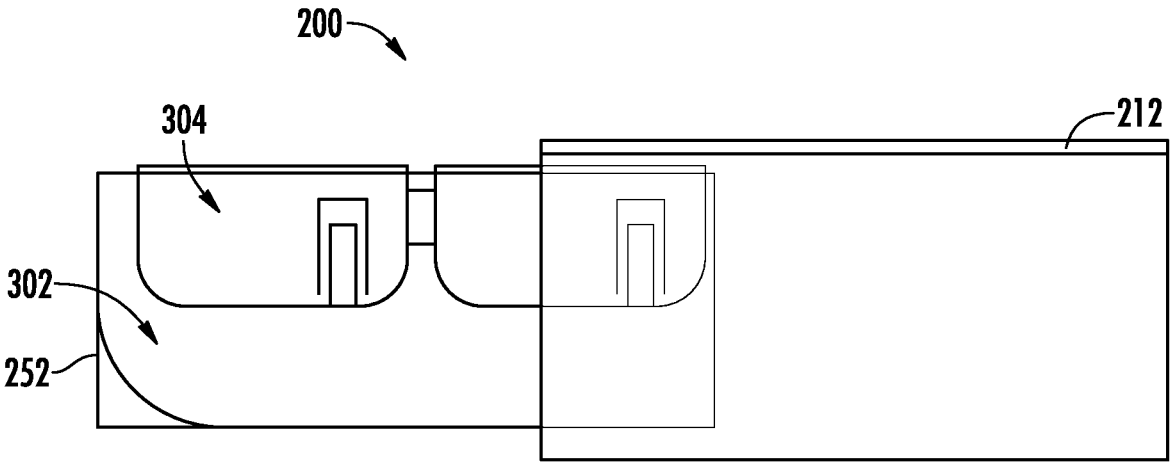
FIG. 4 provides a side, cross-sectional view of an example configuration of the example dispenser box of the washing machine of FIG. 1.

FIG. 3 provides a view of a dispenser box 200 of the washing machine of FIGS. 1 and 2 according to an example embodiment of the present disclosure. More specifically, FIG. 3 provides a partial exploded perspective view of dispenser box 200. As shown in FIG. 3, manifold 212 may include a diffuser assembly 210, in which dispenser box 200 is slidably mounted. Diffuser assembly 210 of manifold 212 is shaped complementary to dispenser box 200, e.g., in a plane that is perpendicular to the vertical direction V, and/or that has a generally rectangular shape. Manifold 212 may extend between a front and a back, e.g., along the transverse direction T, between a top and a bottom, e.g., along the vertical direction V, and between a first side and a second side, e.g., along the lateral direction L.

Further, manifold 212 may define an interior volume. The interior volume of manifold 212 may be sized to receive at least portion of dispenser box 200. Dispenser box 200 may be slidably received within manifold 212, e. g., within the interior volume of manifold 212, referred to as the closed position. Dispenser box 200 may be slidably extended from within manifold 212, e. g., extended out of the interior volume of manifold 212, referred to as the open position. In the open position, dispenser box 200 may be at least partially withdrawn from manifold 212 so that a user may readily access one or more additive chambers of dispenser box 200 e.g., to fill one of the compartments with an additive. The additive chambers will be described in further detail herein. In the closed position, dispenser box 200 may be received within manifold 212, e.g., so that one or more of the additive compartments of dispenser box 200 are in fluid communication with water inlet valve 195 and tub 114 during operation of washing machine 100. Moreover, liquid, such as fresh tap water or wash fluid from tub 114 may flow from manifold 112 into the additive compartments of dispenser box 200. Generally, dispenser box 200 may include a drawer 252 and a handle 254. A user may grasp handle 254 of dispenser box 200 to slide or move dispenser box 200 between the open and closed positions. An opening defined by front panel 104 may allow dispenser box 200 to slide or move between the open and closed positions within cabinet 102.

As seen from the above, referring again to FIG. 3, in the open position dispenser box 200 may be at least partially withdrawn from manifold 212 so that a user may readily access one or more additive chambers of dispenser box 200, e.g., to fill one of the compartments with an additive. At least one of the additive chambers, in the example dispenser box 200, may be powder detergent chamber 302. Powder detergent chamber 302 may be defined by the shape of drawer 252. At least one other additive chamber, liquid detergent chamber 304, may be slidably mounted inside of powder chamber 302. In other words, powder detergent chamber 302 and liquid detergent chamber 304 may be stacked one on top of the other, and liquid detergent chamber 304 may be able to independently slide over top of or away from powder detergent chamber 302. The independent sliding action gives the user selective access and use of each type of detergent.

Figure 5:
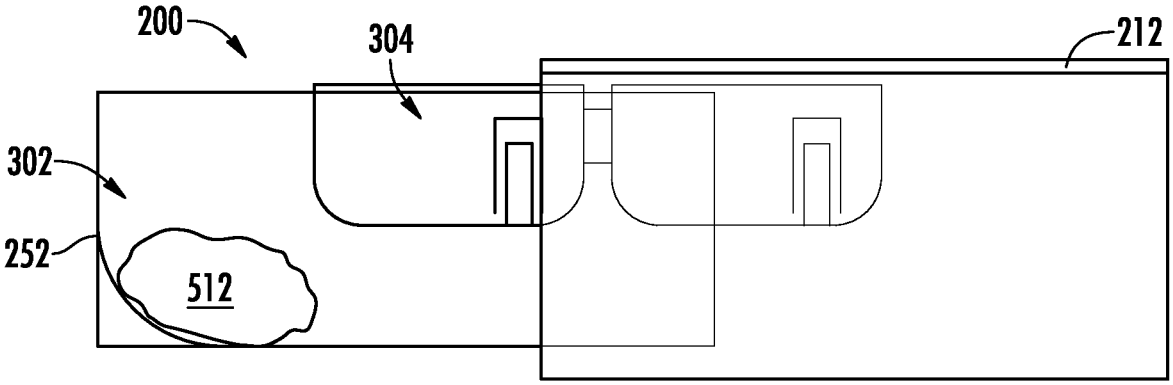
FIG. 5 provides a side, cross-sectional view of a second example configuration of the example dispenser box of the washing machine of FIG. 1.
Figure 6:
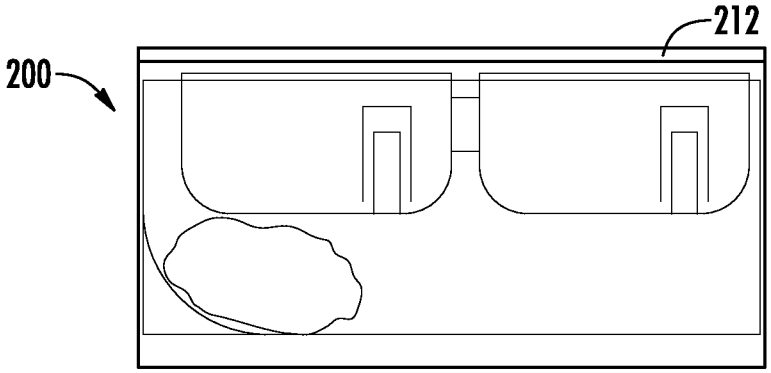
FIG. 6 provides a side, cross-sectional view of a third example configuration of the example dispenser box of the washing machine of FIG. 1.
Figure 7:
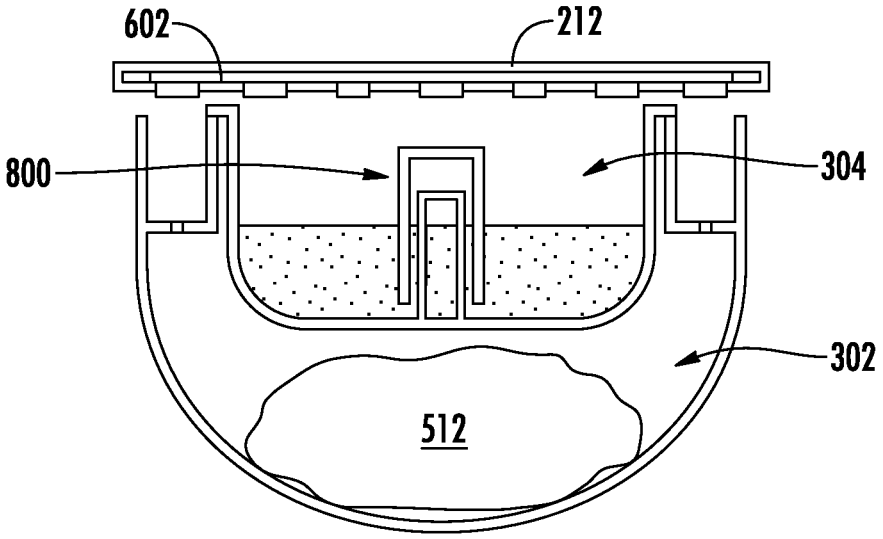
FIG. 7 provides front view of an example shower head in the dispenser box of FIG. 4.

Referring now to FIGS. 5-7, dispenser box 200 is shown in three different configurations. FIG. 5 illustrates when dispenser box 200 is at least partially withdrawn from manifold 212 so that a user may readily access liquid detergent chamber 304. Shown in FIG. 6, liquid detergent chamber 304 may be independently slid away from drawer 252, exposing powder detergent chamber 302, shown with an example powder detergent 512. FIG. 7 illustrates dispenser box 200 in the closed position. When dispenser box 200 is in the closed position, dispenser box 200 is generally referred to as in the default position. When transitioning dispenser box 200 from the arrangement shown in FIG. 6 to the arrangement shown in FIG. 7, liquid detergent chamber 304 returns to the default position within drawer 252.

Figure 8:
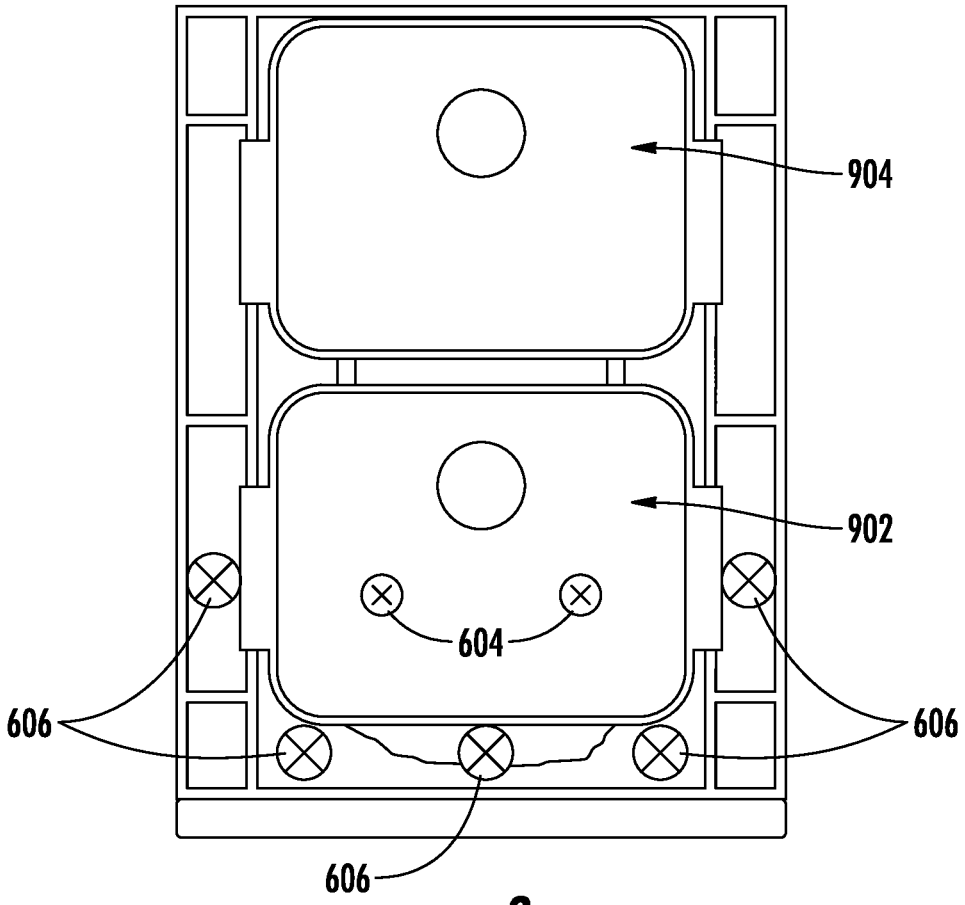
FIG. 8 provides a top-down plan view of the example shower head of FIG. 7.

As best shown in FIGS. 8-9, manifold 212 includes a shower head 602, which may be positioned above both powder detergent chamber 302 and liquid detergent chamber 304 when dispenser box 200 is in the closed position. Shower head 602 creates water jets 604 above liquid detergent chamber 304 and water jets 606 that bypass liquid detergent chamber 304 in order to access powder detergent chamber 302 simultaneously. In other words, manifold 212 may have the ability to use both powder detergent chamber 302 and liquid detergent chamber 304 at the same time. Additionally, using both powder detergent chamber 302 and liquid detergent chamber 304 at the same time may use the same valve action to flush both powder detergent chamber 302 and liquid detergent chamber 304 with fluid from water inlet valve 195. Thus, e.g., a single valve may regulate fluid flow to shower head 602 and thus to both of powder detergent chamber 302 and liquid detergent chamber 304.

Shown in FIG. 8, siphon valve 800 may be used to automatically dilute and empty the contents of liquid detergent chamber 304. Siphon valve 800 is configured such that liquid detergent chamber 304 fills with water and dilutes with the liquid detergent, and, when the liquid level within liquid detergent chamber 304 surpasses the height of an internal pipe within siphon valve 800, the liquid solution is drained from liquid detergent chamber 304. Siphon valve 800 may drain directly into powder detergent chamber 302, combining with the powder detergent, if any, and flushing both chambers. Powder detergent chamber 302 does not include a siphon valve, as water jets 606 from shower head 602 spray directly into powder detergent chamber 302 and mix/dilute with powder detergent 512. Powder detergent chamber 302 may be contoured with curved side walls sloped such that water from water jets 606 is directed into the powder detergent and flushes powder detergent chamber 302. For example, the curved side walls may be positioned directly below the water jets 606 such that liquid from water jets 606 that impacts the curved side walls is redirected towards powder detergent located at a center of powder detergent chamber 302 in order to assist with flushing the powder detergent from powder detergent chamber 302, e.g., even when liquid detergent chamber 304 is positioned over powder detergent chamber 302.

In one example embodiment, such as in FIG. 9, liquid detergent chamber 304 may be slidably mounted to powder detergent chamber 302. In another example embodiment, liquid detergent chamber 304 may be slidably mounted to manifold 212. Additionally, in another example embodiment, liquid detergent chamber 304 may be removable from dispenser box 200 altogether. Liquid detergent chamber 304 may have two compartments. First compartment 902 may be used for liquid detergent, and second compartment 904 may be used for fabric softener, bleach, etc. In certain example embodiments, a volume of first compartment 902 and second compartment 904 may each be no less than about twenty cubic centimeters (20 $cm^3$) and no greater than about two hundred cubic centimeters (200 $cm^3$). Moreover, first compartment 902 and second compartment 904 may each be about five centimeters by about five centimeters (5 cm×5 cm), e.g., along the lateral and transverse directions L, T. In certain example embodiments, a volume of powder detergent chamber 302 may be no less than about fifty cubic centimeters (50 $cm^3$) and no greater than about four hundred cubic centimeters (400 $cm^3$). Moreover, powder detergent chamber 302 may be about seven centimeters by about sixteen centimeters (7 cm×16 cm), e.g., along the lateral and transverse directions L, T.

As may be seen from the above, a stacked set of additive chambers, powder detergent chamber 302 and liquid detergent chamber 304, may be slidably mounted within dispenser box 200. Liquid detergent chamber 304 may be slidably mounted relative to powder detergent chamber 302, providing selective access to powder detergent chamber 302. Both powder detergent chamber 302 and liquid detergent chamber 304 may be used in the same wash cycle, using the same action from water inlet valve 195. Shower head 602 creates water jets that flush both powder detergent chamber 302 and liquid detergent chamber 304 at the same time.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine comprising:

a cabinet;

a tub positioned in the cabinet;

a basket assembly mounted in the tub;

a manifold mounted in the cabinet; and a dispenser box slidably mounted to the manifold and configured to provide selective access to an interior of the dispenser box, wherein a powder detergent chamber configured for receiving powder detergent is defined by the dispenser box at the interior of the dispenser box, wherein a drawer is slidably mounted to the dispenser box within the interior of the dispenser box, the drawer comprising a liquid detergent chamber configured for receiving liquid detergent, the liquid detergent chamber slidably nested within the powder detergent chamber in the interior of the dispenser box, and wherein the manifold includes a shower head positioned above both the powder detergent chamber and the liquid detergent chamber, the shower head configured to jet water from above the liquid detergent chamber and jet water to bypass the liquid detergent chamber in order to access the powder detergent chamber simultaneously.

2. The washing machine of claim 1, further comprising a single valve, the single valve operable to regulate flushing of both the liquid detergent chamber and the powder detergent chamber simultaneously.

3. The washing machine of claim 1, wherein the drawer is slidable between a first position and a second position, the drawer configured for receiving the liquid detergent in the first position of the drawer, the liquid detergent chamber covers the powder detergent chamber in the interior of the dispenser box in the first position.

4. The washing machine of claim 3, wherein the drawer is retracted from the powder detergent chamber when the drawer is in the second position of the drawer, the powder detergent chamber accessible and configured for receipt of the powder detergent when the drawer is in the second position of the drawer.

5. The washing machine as in claim 1, wherein the powder detergent chamber is contoured to flush any contents of the powder detergent chamber.

6. A washing machine comprising:

a cabinet defining an exterior appearance of the washing machine;

a tub positioned in the cabinet;

a basket assembly rotatably mounted in the tub;

a manifold mounted in the cabinet;

a dispenser box slidably mounted to the manifold and configured to provide selective access to an interior of the dispenser box; and a single valve action to flush the dispenser box, wherein a powder detergent chamber configured for receiving powder detergent is defined by the dispenser box at the interior of the dispenser box, wherein a drawer is slidably mounted to the dispenser box within the interior of the dispenser box, the drawer comprising a liquid detergent chamber configured for receiving liquid detergent, the liquid detergent chamber slidably nested within the powder detergent chamber in the interior of the dispenser box, wherein the single valve action flushes both the liquid detergent chamber and the powder detergent chamber simultaneously, and wherein the manifold includes a shower head positioned above both the powder detergent chamber and the liquid detergent chamber, the shower head configured to jet water from above the liquid detergent chamber and jet water to bypass the liquid detergent chamber in order to access the powder detergent chamber simultaneously.

7. The washing machine of claim 6, wherein the drawer comprises a first position configured for receiving liquid detergent, the liquid detergent chamber nested on top of the powder detergent chamber in the interior of the dispenser box.

8. The washing machine of claim 7, wherein the drawer comprises a second position configured to provide selective access to the powder detergent chamber by selectively/independently sliding the liquid detergent chamber in the horizontal direction, exposing the powder detergent chamber.

9. The washing machine as in claim 6, wherein the powder detergent chamber comprises curved slope side walls configured for receiving and directing water to flush the powder detergent chamber.

10. A washing machine comprising:

a cabinet defining the exterior appearance of the washing machine;

a tub positioned in the cabinet;

a basket assembly rotatably mounted in the tub;

a manifold mounted in the cabinet;

a dispenser box slidably mounted to the manifold in the cabinet and movable between an open and a closed position in order to provide selective access to an interior of the dispenser box; and a single valve action to flush the dispenser box, wherein a powder detergent chamber configured for receiving powder detergent is defined by the dispenser box at the interior of the dispenser box, wherein a drawer is slidably mounted to the dispenser box within the interior of the dispenser box, the drawer comprising a liquid detergent chamber, wherein the single valve action flushes both the liquid detergent chamber and the powder detergent chamber simultaneously, and wherein the manifold includes a shower head positioned above both the powder detergent chamber and the liquid detergent chamber, the shower head configured to jet water from above the liquid detergent chamber and jet water to bypass the liquid detergent chamber in order to access the powder detergent chamber simultaneously, wherein the drawer further comprises, a first position configured for receiving liquid detergent, the liquid detergent chamber slidably nested on top of the powder detergent chamber in the interior of the dispenser box, and a second position configured to provide selective access to the powder detergent chamber by selectively/independently sliding the liquid detergent chamber in the horizontal direction, exposing the powder detergent chamber, wherein when the dispenser box is put into the closed position, the drawer defaults to the first position.

11. The washing machine as in claim 10, wherein the powder detergent chamber comprises curved slope side walls configured for receiving and directing water to flush the powder detergent chamber.

12. The washing machine of claim 1, wherein the powder detergent chamber and the liquid detergent chamber are stacked one on top of the other.

13. The washing machine of claim 12, wherein the liquid detergent chamber is independently slidable over top of or away from the powder detergent chamber.

14. The washing machine of claim 6, wherein the powder detergent chamber and the liquid detergent chamber are stacked one on top of the other.

15. The washing machine of claim 14, wherein both of the powder detergent chamber and the liquid detergent chamber may be used simultaneously.

16. The washing machine of claim 15, wherein the liquid detergent chamber is independently slidable over top of or away from the powder detergent chamber.

17. The washing machine of claim 6, wherein both of the powder detergent chamber and the liquid detergent chamber may be used simultaneously.

18. The washing machine of claim 10, wherein both of the powder detergent chamber and the liquid detergent chamber may be used simultaneously.

* * * * *